United States Patent [19]

Sugimoto et al.

[11] Patent Number: 4,614,711

[45] Date of Patent: Sep. 30, 1986

[54] SILVER HALIDE EMULSION

[75] Inventors: Tadao Sugimoto; Toshiaki Hayakawa, both of Kanagawa, Japan

[73] Assignee: Fuji Photo Film Co., Ltd., Kanagawa, Japan

[21] Appl. No.: 638,821

[22] Filed: Aug. 8, 1984

[30] Foreign Application Priority Data

Aug. 8, 1983 [JP] Japan ..... 58-145334

[51] Int. Cl.[4] ..... E03C 1/02

[52] U.S. Cl. ..... 430/567; 430/569

[58] Field of Search ..... 430/567, 569

[56] References Cited

U.S. PATENT DOCUMENTS

| | | | |
|---|---|---|---|
| 3,317,322 | 5/1967 | Porter | 430/567 |
| 3,935,014 | 1/1976 | Klötzer et al. | 430/567 |
| 4,045,228 | 8/1977 | Vanassche et al. | 430/567 |
| 4,477,564 | 10/1984 | Cellone et al. | 430/567 |
| 4,495,277 | 1/1985 | Becker et al. | 430/567 |
| 4,504,570 | 3/1985 | Evans et al. | 430/567 |

FOREIGN PATENT DOCUMENTS

| | | | |
|---|---|---|---|
| 1027146 | 4/1966 | United Kingdom | 430/567 |

*Primary Examiner*—Mary F. Downey

*Attorney, Agent, or Firm*—Sughrue, Mion, Zinn, Macpeak, and Seas

[57] ABSTRACT

A silver halide emulsion containing negative working silver halide grains each comprising a core of silver bromide or silver bromoiodide, a first coating layer exterior the core of silver iodide or silver bromoiodide, and a second coating layer exterior the first coating layer composed of silver bromide or silver bromoiodide different from that of the first coating layer in halide composition, and having a projected area diameter-to-thickness ratio of less than 5, in which:

(1) the first coating layer contains more iodide than the core by 10 mol % or more; and (2) silver in the first coating layer accounts for 0.01 to 30 mol % of the total silver in the grain.

20 Claims, No Drawings

SILVER HALIDE EMULSION

FIELD OF THE INVENTION

This invention relates to a negative working silver halide emulsion.

BACKGROUND OF THE INVENTION

Photographic light-sensitive materials prepared by coating silver halide emulsions generally suffer various mechanical stresses. For example, negative films for ordinary use are folded upon winding into the cassette in which they are sold or loading in a camera, or are stretched upon photographing.

On the other hand, sheet-like films such as light-sensitive materials for printing or X-ray sensitive materials for direct medical use are often folded or bent since they are directly handled.

Every light-sensitive material suffers great stress upon cutting or finishing.

When various stresses as described above are imposed on photographic light-sensitive materials, such stresses reach silver halide grains present through the gelatin medium which is a binder for the silver halide grains or through a plastic film support. Stretched silver halide grains are known to cause changes in photographic properties of photographic light-sensitive materials, as described in , for example, K. B. Mather, *J. Opt. Soc. Am.*, 38, 1054 (1948), P. Faelens and P. de Smet, *Sci. et Ind. Phot.*, 25, No. 5, 178 (1954), P. Faelens, *J. Phot. Sci.*, 2, 105 (1954), etc.

Desensitization of areas where stress has been imposed causes sensitization or fogging, which seriously deteriorates image quality and, with X-ray sensitive materials, can lead to an incorrect diagnosis.

Therefore, it has been desired in the art to develop photographic light-sensitive materials which suffer no harmful influence on photographic properties when they are subjected to such stresses.

As techniques for improving stress properties, it is known to prevent stress from reaching grains by incorporating a polymer or a plasticizer, such as an emulsion, or by reducing the ratio of silver halide to gelatin in a silver halide emulsion.

For example, British Pat. No. 738,618 discloses using heterocyclic compounds, British Pat. No. 738,637 discloses using alkyl phthalates, British Pat. No. 738,639 discloses using alkyl esters, U.S. Pat. No. 2,960,404 discloses using polyhydric alcohols, U.S. Pat. No. 3,121,060 discloses using carboxyalkyl celluloses, Japanese Patent Application (OPI) No. 5017/74 discloses using paraffins and carboxylates (the term "OPI" as used herein refers to a "published unexamined Japanese patent application"), and Japanese Patent Publication No. 28086/78 discloses using alkyl acrylates and organic acids.

However, since the addition of a plasticizer decreases the mechanical strength of an emulsion layer, the amount of the plasticizer to be added is limited. On the other hand, the use of increased gelatin delays development processing speed. Thus, these two techniques provide sufficient effects only with difficulty. Therefore, it would be most desirable to be able to prepare silver halide grains which themselves resist stresses.

When silver nitrate is added to a solution containing, for example, gelatin, KBr, and KI, there results an emulsion which undergoes a serious reduction in light sensitivity when stress is imposed thereto. This reduction in light sensitivity is quite inconvenient, and is removed with pure silver bromide grains or completely uniform silver bromoiodide grains formed by adding a silver nitrate solution and a halide solution according to a double jet-mixing method while avoiding the reproduction of nuclei. However, such grains are easily fogged upon being stressed, which is undesirable.

On the other hand, Japanese Patent Application (OPI) No. 22408/78, Japanese Patent Publication No. 13162/68, *J. Photo. Sci.*, 24, 198 (1976), etc., describe enhancing development activity or enhancing light sensitivity using layered-structure silver halide grains comprising a core with a plurality of shells.

However, silver halide grains obtained for these purposes are not necessarily improved with respect to stress properties, and have problems with desensitization, fogging, etc., upon being stressed. For example, layer structure silver halide grains comprising pure silver bromide (core)/silver bromoiodide (iodide content: 1 mol%)/pure silver bromide as described in Japanese Patent Application (OPI) No. 22408/78 undergo strong fogging when stressed, thus having problems with stress properties similar to conventional uniform silver bromoiodide emulsions.

Silver halide grains having a coating layer formed by substituting the halide in the outermost layer are described in West German Pat. No. 2,932,650, Japanese Patent Application (OPI) Nos. 2417/76, 17436/76, 11927/77, etc. However, they cannot be practically used as negative emulsions since they cause development inhibition and fail to provide sufficient sensitivity, though they accelerate fixing speed.

Positive (internal latent image-forming) silver halide grains comprising an internal core having a plurality of coating layers formed by substitution of halide are known and described in detail in U.S. Pat. Nos. 2,592,250 and 4,075,020, Japanese Patent Application (OPI) No. 127549/80, etc. These silver halide grains are often used in internal latent image-forming, direct positive light-sensitive materials for a diffusion transfer process or the like. They naturally possess too high an internal sensitivity for negative working emulsions to which the present invention is directed.

West German Pat. No. 2,932,650 describes sensitizing the surface of this type of silver halide grains, but such silver halide emulsions do not show improved stress properties.

For example, foregoing Japanese Patent Application (OPI) No. 127549/80 describes an emulsion of silver halide grains prepared by substituting bromide for chloride of the core and iodide for bromide of the core to prepare almost 100% silver iodide cores, then coating them with silver bromoiodide. However, this emulsion strongly undergoes stress desensitization, thus not being practically usable. Even when the grain surfaces are sensitized to convert them to the negative working type, strong stress desensitization still takes place so that the emulsion cannot be practically used.

SUMMARY OF THE INVENTION

It is, therefore, an object of the present invention to provide a silver halide emulsion having free of the problems described above.

Another object of the present invention is to provide a silver halide emulsion which undergoes less change in sensitivity when stressed and which has greatly improved stress properties, i.e., stress sensitization-desensitization and stress fogging.

The above-described objects of the present invention have been attained by the use of a silver halide emulsion containing negative working silver halide grains comprising a core composed of silver bromide or silver bromoiodide, a first coating layer outside the core composed of silver iodide or silver bromoiodide, and a second coating layer outside the first coating layer composed of silver bromide or silver bromoiodide different from that of the first coating layer in halide composition, and having a projected area diameter-to-thickness ratio of less than 5, in which:

(1) the first coating layer contains more iodide than the core by 10 mole% or more; and (2) silver in the first coating layer accounts for 0.01 to 30 mol% of the total silver in the grain.

DETAILED DESCRIPTION OF THE INVENTION

In the present invention, the term "negative working" is used in the sense usually used in this field, and means silver halide grains where surface sensitivity is the same as or more than that (preferably 2-fold or more) of the internal sensitivity of the grain.

The size of silver halide grains of the present invention is presented as projected area diameter. The term "projected area diameter" as used herein means the diameter of a circle having an area equal to the projected area of the grain.

The sizes of silver halide grains are preferably in the range of from 0.5 to 5.0μ, more preferably 1.0 to 3.0μ.

The proejcted area diameter-to-thickness ratio is less than 5 and preferably more than 1. The term "thickness" as used herein means the shortest length of grain through the gravity center thereof.

The silver halide grains of the present invention may have a plate form, a spherical form, a cubic form, etc.

When the core of the present invention comprises silver bromoiodide, it preferably forms a homogeneous solid solution phase. The term "homogeneous" as used herein means that 95 mol% of the silver halides of the core have an iodide content falling within ±40 mol% of the mean silver iodide content.

As to halide composition of the core, the mean iodide content is preferably 10 mol% or less, more preferably 0 to 5 mol%, most preferably 0 to 3 mol%.

Silver in the core preferably accounts for 5 mol% or more, more preferably 10 to 95 mol%, of the total silver in the grain.

The silver iodide content in the first coating layer is more than that of the core by 10 mol% or more, preferably 20 mol% or more, more preferably 40 mol% or more.

The silver iodide content of the first coating layer is 10 mol% to 100 mol%, preferably 20 mol% to 100 mol %, more preferably 40 mol% to 100 mol%.

The silver of the first coating layer accounts for 0.01 to 30 mol%, preferably 0.01 to 10 mol%, more preferably 0.01 to 1.0 mol%, most preferably 0.02 to 0.5 mol%, of the total silver of the grain.

The thickness of the first coating layer is preferably less than 1.7μ.

Where the second coating layer comprises silver bromoiodide, it is not necessarily required to have a homogeneous composition, though homogeneous silver bromoiodide is more preferable.

The second coating layer must sufficiently cover the first coating layer and, for this purpose, the thickness of the second layer is preferably 0.02μ or more and less than 3.0μ, more preferably 0.04μ or more and less than 1.5μ.

The silver iodide content of the second coating layer preferably ranges from 0 to 10 mol%, more preferably from 0 to 5 mol%, most preferably from 0 to 3 mol%.

The silver iodide content of the second coating layer is preferably less than that of the first coating layer.

The silver of the second coating layer preferably accounts for 5 to 90 mol% of the total silver of the grain.

The silver halide grains of the present invention are not limited as to size distribution, with mono-disperse grains being more desirable. The term "mono-disperse" as used herein means a dispersion system wherein 95% by a number of the particles are of sizes falling within ±60%, preferably ±40%, of the number average particle size. The term "number average particle size" as used herein means the number average diameter of the projected area diameter of the grains.

The content of the silver halide grains of the present invention in the emulsion layer containing them is not particularly limited, but is preferably 40% or more in terms of the silver amount of the total silver halide grains present, particularly preferably 90% or more.

The silver halide emulsion of the present invention is prepared as follows.

In general, after the formation of cores comprising silver bromide or silver bromoiodide (iodide content: 10 mol% or less), a first coating layer comprising silver bromoiodide or silver iodide is formed on each of the cores according to a conventional halide substitution method or coating method, then a second coating layer comprising silver bromoiodide different from that of the first coating layer in halide composition or silver bromide is provided on the first coating layer using one of the two recited procedures, with the iodide content of the first coating layer being controlled to be more than that of the core by 10 mol% or more and the silver amount of the first coating layer being 0.01 to 30 mol% of that of the total silver halide grains.

Detailed descriptions are given below.

First, cores of the silver halide grains of the present invention can be prepared by processes as described in P. Glafkides, *Chemie et Physique Photographique* (Paul Montel, 1967), G. F. Duffin, *Photographic Emulsion Chemistry* (The Focal Press, 1966), V. L. Zelikman et al., *Making and Coating Photographic Emulsion* (The Focal Press, 1964), etc. That is, any of an acidic process, a neutral process, and an ammoniacal process may be used and, as a manner of reacting a soluble silver salt with a soluble halide salt, any of the single jet-mixing method, the double jet-mixing method, a combination thereof, etc., may be employable.

A method of forming grains in the presence of excess silver ion (reverse-mixing method) may also be employed. One of the modes of the double jet-mixing method is a method in which the pAg of the liquid phase in which the silver halide is to be produced is kept constant, that is, the controlled double jet method, can be used. This method can be used to produce silver halide emulsions having a regular crystal form and an almost uniform grain size.

Two or more silver halide emulsions separately prepared may also be mixed for use.

In preparing cores of silver halide grains, the silver halide composition is preferably uniformly controlled. With cores composed of silver bromoiodide, the double jet-mixing method or the controlled double jet method are preferably employed.

The pAg employed upon preparation of the cores varies depending upon the reaction temperature and the kind of silver halide solvent, with 7 to 11 being preferable. The use of a silver halide solvent is preferable because it shortens the grain-forming time. For example, well known silver halide solvents such as ammonia and thioether can be used.

The cores may be in a plate form, a spherical form, a twin form, an octahedral form, a cubic form, a tetradecahedral form, a mixed form thereof, etc.

The cores may be in a polydisperse system or a monodisperse system, with a monodisperse system being more preferable. The term "monodisperse" is used in the same sense as defined hereinbefore.

In order to make grain sizes uniform, it is preferable to allow the grains to rapidly grow without exceeding critical supersaturation by employing a method of changing the rate of adding silver nitrate or alkali halide aqueous solution according to the grain-growing rate procedure described in British Pat. No. 1,535,016, Japanese Patent Publication Nos. 36890/73 and 16364/77, or by employing a method of changint the concentration of the aqueous solution as described in U.S. Pat. No. 4,242,445, Japanese Patent Application (OPI) No. 158124/80, etc. These methods are also preferably used for forming the first and second coating layers to be described hereinafter since they enable one to uniformly coat silver halide grains without reproducing nuclei.

During formation or physical ripening of the cores of the silver halide grains, cadmium salts, zinc salts, lead salts, thallium salts, iridium salts or complex salts thereof, rhodium salts or complex salts thereof, iron salts or complex salts thereof, etc., may be present in a conventional manner.

The first coating layer of the silver halide grains of the present invention may be formed, for example, by subjecting formed cores to a conventional halide substitution method or silver halide-coating method after, if necessary, desalting the cores.

The halide substitution method may be conducted by, for example, forming cores and adding an aqueous solution containing mainly an iodide compound (preferably potassium iodide), preferably a 10% or less aqueous solution, to the cores. In this case, 0.01 to 30 mol%, based on the moles of the silver in the finished grains, of the iodide compound is added. The pAg upon addition is preferably 5 to 12. Detailed descriptions are given in U.S. Pat. Nos. 2,592,240, 4,075,020, Japanese Patent Application (OPI) No. 127549/80, etc. In order to reduce grain-to-grain iodide distribution differences in the first coating layer, it is desirable to adjust the concentration of the iodide aqueous solution to $10^{-2}$ mol% or less and add the solution over 10 minutes or longer.

The method of freshly coating silver halide around the cores can be conducted by, for example, simultaneously adding an aqueous halide solution and an aqueous silver nitrate solution, i.e., by the double jet-mixing or controlled double jet method. Detailed descriptions thereof are given in Japanese Patent Application (OPI) No. 22408/78, Japanese Patent Publication No. 13162/68, *J. Photo. Sci.*, 24, 198 (1976), etc.

In this occasion, an aqueous halide solution containing 0.01 to 30 mol%, based on the mols of the silver in the finished grains, of silver nitrate, an equimolar or more (up to about 2-fold) amount, to that of the silver nitrate, of an iodide compound and, if necessary, silver bromide is added.

The pAg upon formation of the first coating layer varies depending upon the reaction temperature and kind and amount of silver halide solvent used, but a pAg of the aforesaid range (pAg of 5–12) is similarly used.

As the method for forming the first coating layer, the double-jet mixing method or the controlled double jet method are more preferable.

The second coating layer of the silver halide grains of the present invention may be formed by, for example, depositing silver halide of a different halide composition from that of the first coating layer around the first coating layer formed outside the cores, by the double jet-mixing method or the controlled double jet method.

As to these methods, those for forming the first coating layer described hereinbefore can be similarly used.

Upon formation of the second coating layer, it is necessary to take any change in the critical super-saturation into consideration because in some cases the second coating layer is difficult to deposit on the surface of the first coating layer due to the difference therebetween in halide composition. Also, it is preferable to increase the amount, per unit time, of the silver halide composition to be added with the increase in the total surface area of the grains.

Where the second coating layer is composed of silver bromide, a method comprising adding an aqueous silver nitrate solution to a composition containing the cores having previously formed first coating layer thereon and a bromide compound (single jet-mixing method) may also be used.

The second coating layer preferably has a homogeneous halide composition. For this purpose, the second coating layer composed of silver bromoiodide is preferably formed according to the double jet-mixing method or the controlled double jet method. The second coating layer composed of silver bromide is preferably formed according to the single jet-mixing method.

The iodide content of the first coating layer of silver halide grains in accordance with the present invention can be determined by, for example, the method described in J. I. Goldstein and D. B. Williams, *X-Ray Analysis in TEM/ATEM* (Scanning Electron Microscopy, 1977, Vol. 1, IIT Research Institute), p, 651 (March, 1977).

In the preparation of the silver halide grains of the present invention, soluble salts may be removed from the emulsion after deposition of the second coating layer, after physical ripening or, if necessary, after formation of the cores or formation of the first coating layer, by the noodle washing method in which gelatin is subjected to gelation. Further, a flocculation method which employs an inorganic salt, an anionic surfactant, an anionic polymer (e.g., polystyrenesulfonic acid) or a gelatin derivative (e.g., acylated gelatin, carbamoylated gelatin, etc.) may be employed.

The silver halide emulsion is usually subjected to chemical sensitization of the grain surfaces. Chemican sensitization can be conducted according to the processes described in, for example, H. Frieser, *Die Grundlagen der Photographischen Prozesse mit Silberhalogeniden* (Akademische Verlagsgesellschaft, 1968), pp. 675–734. That is, sulfur sensitization using sulfur-containing compounds or active gelatin capable of reacting with silver ions, reduction sensitization using a reductive substance, and noble metal sensitization using compounds of noble metals such as gold can be employed alone or in combination. As the sulfur sensitizer, thiosulfates, thioureas, thiazoles, rhodanines, and other compounds can be used. Specific examples thereof are described in U.S. Pat. Nos. 1,574,944, 2,410,689, 2,278,947, 2,728,668, 3,656,955, 4,032,928, 4,067,740, etc. As the reduction sensitizer, stannous salts, amines, hydrazine derivatives, formamidine-sulfinic acids, silane compounds, etc., can be used. Specific examples thereof are described in U.S. Pat. Nos. 2,487,850, 2,419,974, 2,518,698, 2,983,609, 2,983,610, 2,694,637, 3,930,867 and 4,054,458. For noble metal sensitization, complexes of group VIII metals such as platinum, iridium, palladium, etc., can be used as well as gold complexes. Specific examples thereof are described in U.S. Pat. Nos. 2,399,083, 2,448,060, British Pat. No. 618,061, etc.

The silver halide grains of the present invention may be chemically sensitized by a combination of two or more of these sensitizing processes.

The silver amount in the silver halide grains of the present invention coated is not limited, but is preferably, 1,000 mg/m$^2$ to 15,000 mg/m$^2$, more preferably 2,000 mg/m$^2$ to 10,000 mg/m$^2$.

The light-sensitive layer containing such grains may exist on one or both sides of a support.

As a binder or a protective colloid for the photographic emulsion of the present invention, gelatin is advantageously used. However, other hydrophilic colloids can be used as well. For example, proteins such as gelatin derivatives, graft polymers of gelatin and another high polymer, albumin, casein, etc.; cellulose derivatives such as hydroxyethyl cellulose, carboxymethyl cellulose, cellulose sulfate, etc.; sugar derivatives such as sodium alginate, starch derivative, etc.; and various synthetic hydrophilic substances such as homopolymers or copolymers (e.g., polyvinyl alcohol, partially acetalized polyvinyl alcohol, poly-N-vinylpyrrolidone, polyacrylic acid, polymethacrylic acid, polyacrylamide, polyvinyl imidazole, polyvinyl pyrazole, etc.) can be used.

As the gelatin, acid-processed gelatin or enzyme-processed gelatin as described in *Bull. Soc. Sci. Phot. Japan,* No. 16, p. 30 (1966) may be used as well as lime-processed gelatin, and a gelatin hydrolyzate or an enzyme-decomposed product can be used. As the gelatin derivatives, those obtained by reacting gelatin with various compounds such as acid halides, acid anhydrides, isocyanates, bromoacetic acid, alkanesultones, vinyl-sulfonamides, maleinimide compounds, polyalkylene oxides, epoxy compounds, or the like can be used.

The photographic emulsion of the present invention can contain various compounds for the purpose of preventing fogging in the steps of producing light-sensitive materials, during storage or during photographic processing of light-sensitive materials, or for stabilizing photographic properties. That is, azoles (e.g., benzothiazolium salts, nitroindazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (particularly 1-phenyl-5-mercaptotetrazole), etc.); mercaptopyrimidines; mercaptotriazines; thioketo compounds such as oxazolinethione; azaindes (e.g., triazaindenes, tetraazaindenes (particularly 4-hydroxy- substituted) (1,3,3a,7)tetraazaindenes), pentaazaindenes, etc.); benzenethiosulfonic acid, benzensulfinic acid, benzenesulfonic acid amide, etc., known as antifoggants or stabilizers, can be added.

Light-sensitive materials using the photographic emulsion(s) of the present invention may contain in the photographic emulsion layer or other hydrophilic colloid layers various surfactants for various purposes such as improvement of coating properties, antistatic properties, slipping properties, emulsion dispersibility, antiadhesion properties, and photographic properties (for example, development acceleration, realization of contrasty tone, sensitization, etc.). For example, there can be used nonionic surfactants such as saponin (steroid type), alkylene oxide derivatives (e.g., polyethylene glycol, polyethylene glycol/polypropylene glycol condensates, polyethylene glycol alkyl ethers or polyethylene glycol alkylaryl ethers, polyethylene glycol esters, polyethylene glycol sorbitan esters, polyalkylene gylcol alkylamines or amides, polyethylene oxide adducts of silicone, etc.), glycidol derivatives (e.g., alkenylsuccinic acid polyglyceride, alkylphenol polyglycerides, etc.), fatty acid esters of polyhydric alcohols, and sugar alkyl esters, anionic surfactants having acidic groups such as a carboxy group, sulfo group, phospho group, sulfuric ester group or phosphoric ester group, such as alkylcarboxylates, alkylsulfonates, alkylbenzenesulfonates, alkylnaphthalenesulfonates, alkylsulfuric esters, alkylphosphoric esters, N-acyl-N-alkyltaurines, sulfosuccinic esters, sulfoalkylpolyoxyethyene alkylphenyl ethers, polyoxyethylene alkylphosphoric esters, etc.; amphoteric surfactants such as amino acids, aminoalkylsulfonic acids, aminoalkylsulfuric acid esters or aminoalkylphosphoric acid esters, alkylbetaines, amine oxides, etc.; and cationic surfactants such as alkylamine salts, aliphatic or aromatic quaternary ammonium salts, heterocyclic quaternary ammonium salts (e.g., pyridinium or imidazolium), aliphatic or hetero ring-containing phosphonium or sulfonium salts, etc., can be used.

The photographic emulsions used in the present invention may be spectrally sensitized with methine dyes or the like. These sensitizing dyes may be used alone or in combination. A combination of sensitizing dyes is often employed particularly for the purpose of supersensitization. A dye which itself does not have a spectral sensitizing effect or a substance which substantially does not absorb visible light and which shows a supersensitizing effect may be incorporated together with the sensitizing dye.

Useful sensitizing dyes, combination of dyes showing supersensitization, and substances showing a supersensitizing effect are described in *Research Disclosure,* Vol. 176, 17643 (December 1978), p. 23, IV-J.

Photographic light-sensitive materials using the photographic emulsion of the present invention may contain an inorganic or organic hardener in the photographic emulsion layer(s) or other hydrophilic colloidal layers. For example, chromium salts (e.g., chromium alum, chromium acetate, etc.), aldehydes (e.g., formaldehyde, glyoxal, glutaraldehyde, etc.), N-methylol compounds (e.g., dimethylolurea, methyloldimethylhydantoin, etc.), dioxane derivatives (e.g., 2,3-dihydroxydioxane, etc.), active vinyl compounds (e.g., 1,3,5-triacryloyl-hexahydro-s-triazine, 1,3-vinyl-sulfonyl-2-propanol, etc.), active halogen compounds (e.g., 2,4-dichloro-6-hydroxy-s-triazine, etc.), mucohalogenic acids (e.g., mucochloric acid, mucophenoxy-chloric acid, etc.), can be used alone or in combination.

Photographic light-sensitive materials using the photographic emulsion(s) of the present invention may contain in the photographic emulsion layer or other hydrophilic colloidal layers a water-insoluble or slightly water-soluble synthetic polymer dispersion for the purpose of improving dimensional stability or the like. For example, polymers containing as monomer components alkyl(meth)acrylates, alkoxyalkyl(meth)acrylates, glycidyl(meth)acrylates, (meth)acrylamides, vinyl esters (e.g., vinyl acetate), acrylonitrile, olefins, styrene, etc., alone or in combination, or polymers containing as monomer components combinations of the above-described monomers and acrylic acid, methacrylic acid, $\alpha,\beta$-unsaturated dicarboxylic acid, hydroxyalkyl(meth)acrylate, sulfoalkyl(meth)acrylate, styrenesulfonic acid, etc., may be used.

Photographic light-sensitive materials using the photographic emulsion(s) of the present invention may contain in the photographic emulsion layer color-forming couplers, i.e., compounds capable of forming color by oxidative coupling with an aromatic primary amine developing agent (for example, a phenylenediamine derivative or an aminophenol derivative) in color development processing. For example, magenta couplers to be used include 5-pyrazolone couplers, pyrazolobenzimidazole couplers, cyanoacetylcoumarone couplers, open-chain acylacetonitrile couplers, etc.; yellow couplers include acylacetamide couplers (e.g., benzoylacetanilides, pivaloylacetanilides, etc.); and cyan couplers include naphthol couplers, phenol couplers, etc. Of these couplers, nondiffusible couplers having a hydrophobic group called a ballast group are desirable. The couplers may be of either the 4-equivalent or 2-equivalent type based on silver ions. Colored couplers having a color-correcting effect or couplers capable of releasing a development inhibitor upon development (called DIR couplers) may also be used. In addition to DIR couplers, DIR coupling compounds capable of forming a colorless coupling reaction product and releasing a development inhibitor may also be incorporated.

In the practice of the present invention, the following known fading-preventing agents can be used. Such color image-stabilizing agents used in the present invention may be used alone or as a combination of two or more. The known fading-preventing agents include, for example, hydroquinone derivatives, gallic acid derivatives, p-alkoxyphenols, p-hydroxyphenols, bisphenols, and the like.

The light-sensitive material of the present invention may contain in a hydrophilic colloid layer an ultraviolet ray absorbent. For example, aryl group-substituted benzotriazole compounds, 4-thiazolidone compounds, benzophenone compounds, cinnamic esters, butadiene compounds, benzoxazole compounds, ultraviolet ray-absorbing polymers, etc., may be used. These ultraviolet ray absorbents may be immobilized in the hydrophilic colloidal layer, if desired.

The light-sensitive material of the present invention may contain in a hydrophilic layer a water-soluble dye as a filter dye or for various purposes such as prevention of irradiation. Such dye includes oxonol dyes, hemioxonol dyes, styryl dyes, merocyanine dyes, cyanine dyes, and azo dyes. Of these, oxonol dyes, hemioxonol dyes, and merocyanine dyes are particularly useful.

The light-sensitive material of the present invention may contain a hydroquinone derivative, an aminophenol derivative, a gallic acid derivative, an ascorbic acid derivative, etc., as a color fog-preventing agent.

The present invention may be applied to a multilayered multicolor photographic material having at least two light-sensitive layers different in spectral sensitivity. Multilayered color photographic materials usually comprise a support having provided thereon at least one red-sensitive emulsion layer, at least one green-sensitive emulsion layer, and at least one blue-sensitive emulsion layer. The order of these layers may be optionally selected as the case demands. Usually, the red-sensitive emulsion layer is associated with a cyan-forming coupler, the green-sensitive emulsion layer is associated with a magneta-forming coupler, and the blue-sensitive emulsion layer is associated with a yellow-forming coupler, though different combinations are possible in some cases.

In the photographic light-sensitive material of the present invention, photographic emulsion layers and other hydrophilic colloidal layers may be coated on a support or other layer by various known methods. For the coating, a dip coating method, a roller coating method, a curtain coating method, an extrusion coating method, etc., may be used. Methods as described in U.S. Pat. Nos. 2,681,294, 2,761,791 and 3,526,528 are advantageous. As the support, cellulose ester films such as a cellulose triacetate film, polyester films such as a polyethylene terephthalate film, paper coated with an $\alpha$-olefin polymer, or the like, are preferable.

The silver halide emulsion of the present invention may be used for color light-sensitive materials such as color negative working light-sensitive materials, color reversal light-sensitive materials, color papers, etc., as well as black-and-white light-sensitive materials such as direct or indirect X-ray sensitive materials, lith type light-sensitive materials, black-and-white light-sensitive materials for photography, etc.

In photographic processing of the light-sensitive material of the present invention, any known processes and known processing solutions as described in, for example, *Research Disclosure,* 176, pp. 28–30 (RD-17643) may be employed. Such processing may be a black-and-white photographic processing for forming a silver image or a color photographic processing for forming a dye image, depending upon the purpose. The processing temperature is usually selected between 18° and 50° C. However, temperatures lower than 18° C. or higher than 50° C. may be employable.

The developing solution for conducting black-and-white photographic processing can contain known developing agents in a conventional amount. As the developing agents, dihydroxybenzenes (e.g., hydroquinone), 3-pyrazolidones (e.g., 1-phenyl-3-pyrazolidone), aminophenols (e.g., N-methyl-p-aminophenol), etc., can be used alone or in combination. Generally, the developing solution further contains known preservatives, alkali agents, pH buffers, antifogging agents, etc., and, if necessary, may further contain dissolving aids, toning agents, development accelerators, surfactants, defoaming agents, water-softening agents, hardeners, viscosity-imparting agents, etc.

As a fixing solution, those which have the same formulation as are ordinarily employed can be used.

As a fixing agent, organic sulfur compounds which are known to function as fixing agents can be used as well as thiosulfates and thiocyanates. The fixing solution may contain a water-soluble aluminum salt as a hardener.

In forming dye images, ordinary processes can be applied. For example, there may be employed a negative-positive process (described in, for example, *Journal of the Society of Motion Picture and Television Engineers,* Vol. 61 (1953), pp. 667–701); a color reversal process of forming a negative silver image by developing with a developing solution containing a black-and-white developing agent, conducting at least one uniform exposure or other proper fogging processing, and subsequently conducting color development to thereby obtain positive dye images; a silver dye-bleaching process of forming a silver image by developing a dye-containing photographic emulsion layer after imagewise exposure to thereby form a silver image, and bleaching the dye using the silver image as a bleaching catalyst; and the like.

A color developing solution generally is an aqueous alkaline solution containing a color-developing agent. As the color-developing agent, known primary aromatic amine developing agents such as phenylenediamines (e.g., 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline, 4-amino-3-methyl-N-ethyl-N-β-methoxyethylaniline, etc.) can be used.

In addition, those described in L. F. A. Mason, *Photographic Processing Chemistry,* (Focal Press, 1966), pp. 226–229, U.S. Pat. Nos. 2,193,015 and 2,592,364, Japanese Patent Application (OPI) No. 64933/73, etc., can be used.

Th color developing solution may further contain a pH buffer, a development inhibitor, or an anti-fogging agent and, if necessary, may contain a water softener, a preservative, an organic solvent, a development accelerator, a dye-forming coupler, a competitive coupler, a fogging agent, an auxiliary developing agent, a viscosity-imparting agent, a polycarboxylic acid type chelating agent, an antioxidant, etc.

Color-developed photographic emulsion layers are usually bleached. Bleaching may be conducted separately or simultaneously with fixing. As the bleaching agents, compounds of polyvalent metals such as iron (III), cobalt (IV), chromium (VI), copper (II), etc., peracids, quinones, nitroso compounds, etc., are usually used.

To the bleaching or bleach-fixing solution there may be added various additives as well as bleaching accelerators as described in U.S. Pat. Nos. 3,042,520, 3,241,966, Japanese Patent Publication Nos. 8506/70, 8836/70, etc., and thiol compounds described in Japanese Patent Application (OPI) No. 65732/78.

The present invention will now be described in more detail by the following non-limiting examples of preferred embodiments of the present invention. Unless otherwise indicated, all percents are by weight.

Example 1

(I) Preparation of Comparative Sample I-1

(1) Preparation of Silver Bromoiodide Grains for Phase A (core):

30 g of gelatin, 8 g of potassium bromide, and 80 cc of a 0.1% methanol solution of 3,4-dimethyl-4-thiazoline-2-thione were added to 1 liter of water and, while keeping the temperature of the reaction vessel at 75° C., 800 ml of an aqueous solution (Solution A) containing 250 g per liter of silver nitrate and 780 ml of an aqueous solution (Solution B) containing 5 g per liter of potassium iodide and 206 g per liter of potassium bromide were simultaneously added thereto over 60 minutes according to the double jet-mixing method while keeping the pBr at 1.41. The silver halide grains thus-prepared were octahedral silver bromoiodide grains having a size (defined in terms of projected area diameter) of 0.91 μm and containing 2 mol% silver iodide.

(2) Growth of Phase C (coating layer):

34 g, as silver weight, of the Phase A Emulsion described in (1), 790 cc of water, 15 g of gelatin, and 80 cc of a 0.1% methanol solution of 3,4-dimethyl-4-thiazoline-2-thione were mixed and, while stirring the mixture in the reaction vessel kept at 75° C., 650 cc of a 0.64N $AgNO_3$ solution and 650 cc of a 1.09N KBr solution were simultaneously added thereto over 50 minutes according to the double jet-mixing method while deeping the pBr at 1.41. The silver halide grains thus obtained were monodisperse octahedral grains of a 1.45 μm mean diameter having a core/shell structure which comprised Phase A and Phase C of pure silver bromide.

To the thus-obtained silver halide emulsion were added $6\times10^{-6}$ mol, per mol of silver, of chloroauric acid and $1.3\times10^{-5}$ mol, per mol of silver, of sodium thiosulfate and, after conducting chemical ripening at 60° C. for 60 minutes, $3\times10^{-3}$ mol of 4-hydroxy-6-methyl-1,3,3a,7-tetraazaindene per mol of silver was added thereto. After adding thereto a coating aid, the resulting emulsion was coated on a polyethylene terephthalate film base in a silver amount of 4 g/m$^2$ (Comparative Sample I-1).

(II) Preparation of Silver Bromoiodide by Introducing Phase B (first coating layer) According to the Iodide Ion Substitution Method In a manner identical to that for Comparative Sample I-1 except for adding 100 cc of an aqueous KI solution per 34 g, as silver amount, of the Phase A Emulsion over 10 minutes under stirring, Phase B (first coating layer) was formed before the growth of Phase C and then Phase C (second coating layer) of pure silver bromide was formed to obtain 1.45 μm size, monodisperse octahedral grains. Thus, Samples I-2, I-3, I-4, I-5, I-6 and I-7 were prepared using respectively 0.1 g, 0.2 g, 0.3 g, 0.4 g, 1.0 g, and 2.0 g of KI per 100 ml of aqueous KI solution. Chemical ripening and subsequent steps were the same as in Example 1, (1).

(III) Evaluation of Stress Properties of the Above-Described Samples

Each of the thus-obtained samples was coated on a film and folded at 25° C. under moisture conditioning at a relative humidity of 40% for several ten minutes. This folding was conducted along an iron rod 6 mm in diameter at an angle of 180°. Immediately after this procedure, each sample was wedge-exposed for $10^{-2}$ second. The thus-exposed samples were developed for 10 minutes using the following surface developing solution at 20° C., then fixed and washed with water.

| Surface Developing Solution | |
|---|---|
| Monomethyl-p-aminophenol Sulfate | 5 g |
| L-Ascorbic Acid | 20 g |
| $Na_2BO_3$ | 70 g |
| KBr | 2 g |
| Water to make | 1 liter |

The ratio of change in fog by folding to maximum density, ΔFog/Dm, of each sample is shown in Table 1.

TABLE 1

Relationship between mol fraction of Phase B introduced by iodide substitution and Δ Fog/Dm [Phase A: AgBrI (I = 2 mol %); Phase B: AgI; Phase C: AgBr; molar ratio of silver in Phase A to that in Phase C = 1/3]

| Sample No. | Mol Fraction (%) of Ag in Phase B to the Total Ag | Δ Fog/Dm |
|---|---|---|
| I-1 (Comparative) | 0 | 0.080 |
| I-2 (Invention) | 0.001 | 0.080 |
| I-3 (Invention) | 0.01 | 0.070 |
| I-4 (Invention) | 0.10 | 0 |
| I-5 (Invention) | 0.20 | 0 |
| I-6 (Invention) | 0.50 | 0 |
| I-7 (Invention) | 1.00 | 0 |

As is clear from Table 1, in comparison with Samples I-1 having only a single coating layer and I-2 having a first and a second layers of only 0.001 in mol fraction of silver, Samples I-3 to I-7 having a first coating layer and a second coating layer of about 0.01 to 1.00 in mol fraction of silver showed reduced or no fog increase.

In addition, Samples I-3 to I7 underwent only a slight change in sensitivity by folding, thus being preferable.

EXAMPLE 2

(I) Preparation of Comparative Sample II-1

A comparative sample (Comparative Sample II-1) containing 1.4 μm octahedral grains was prepared in the same manner as with Comparative Sample I except for using a solution prepared by mixing 650 cc of a 1.09N KBr solution containing 3.3 g of KI in place of the 1.09N KBr solution used in Example 1, (I)-(2), for the growth of Phase C, to thereby allow Phase C to grow on Phase A prepared in Example 1, (I)-(1), with both Phase A and Phase C uniformly having a silver iodide content of 2 mol%.

(II) Preparation of Silver Bromoiodide Having Introduced thereon Phase B of Silver Iodide (first coating layer)

In the same manner as above-described Comparative Sample II-1 except for simultaneously adding, before the growth of Phase C 100 ml per 34 g, as silver amount, of Phase A Emulsion with a varying concentration of KI aqueous solution and 100 ml of an aqueous solution containing an equivalent amount of $AgNO_3$ at 75° C. over 10 minutes, followed by allowing Phase C to grow having the same composition as that of Phase A, 1.4 μm, mono-disperse octahedral silver halide grains were obtained. Chemical sensitization of the grains was conducted under the same condition as with each sample in Example 1 to prepare Samples II-2 to II-6.

These samples were subjected to the same stress properties test as in Example 1.

The relationship between the mol fraction of Phase B, ΔFog/Dm, and ΔS with each sample are shown in Table 2. ΔS means the change in sensitivity, with the sensitivity being defined as a logarithm of the reciprocal of the exposure amount needed to give an optical density higher than fog by 0.1.

TABLE 2

Relationship between mol fraction of Phase B formed by simultaneously introducing KI solution and equivalent amount of $AgNO_3$ aqueous solution, Δ Fog/Dm, and Δ S [Phase A and Phase C: AgBrI (I =2 mol %); Phase B: AgI molar ratio of Ag in Phase A to that in Phase C = 1/3]

| Sample No. | Mole Fraction (%) of Ag in Phase B to the Total Ag | Δ Fog/Dm | Δ S |
|---|---|---|---|
| II-1 (Comparative) | 0 | 0.043 | +0.05 |
| II-2 (Invention) | 0.05 | 0.014 | +0.03 |
| II-3 (Invention) | 0.10 | 0 | −0.01 |
| II-4 (Invention) | 0.15 | 0 | −0.08 |
| II-5 (Invention) | 0.50 | 0 | −0.15 |
| II-6 (Invention) | 1.00 | 0 | −0.24 |

As is clear from Table 2, it is seen that not only does direct halide substitution with iodide ions as in Example 1 but also the introduction of Phase B having a higher iodide content than that of Phase A serve to remarkably improve stress properties (ΔFog/Dm) without any serious change in sensitivity similar to Example 1.

EXAMPLE 3

30 g of gelatin, 0.4 g of KBr, and 30 cc of 25% aqueous ammonia were added to 1 liter of water and, while keeping the reaction vessel temperature at 50° C., and then, at the same temperature, 13 cc of an aqueous solution (Solution A) containing 250 g per liter of $AgNO_3$ and 13 cc of an aqueous solution (Solution B) containing 180 g per liter of KBr were simultaneously added thereto over 1 minute. Then, again at 50° C., Solution B was simultaneously added thereto with 187 cc of Solution A according to the potential-controlling method so as to keep the pBr at 2.44 (Phase A, or core). Subsequently, 200 cc of a KI aqueous solution was added thereto over 20 minutes under stirring at 50° C. to introduce Phase B (first coating solution). Then, Phase C (second coating layer) was formed in the same manner as with Phase A to obtain 1.66 μm monodisperse cubic grains composed of Phase A and Phase C. Samples III-2 to III-6 were obtained by varying the amount of KI contained in the 200 cc aqueous solution used for introducing Phase B as 0.05 g, 0.1 g, 0.2 g, 0.3 g, and 0.4 g. As a comparative emulsion, an emulsion not using this KI solution was prepared (Comparative Sample III-1). To each of the thus-obtained silver halide emulsions were added $1.9\times10^{-6}$ mol of chloroauric acid and $4\times10^{-5}$ mol of sodium thiosulfate per mol of silver, and chemical ripening was conducted at 55° C. for 60 minutes. Coating steps and subsequent steps were the same as in Example 1, (2). The thus-obtained Samples III-1 to III-6 were subjected to the stress properties test. The relationship between mol fraction of Phase B, ΔFog/Dm, and ΔS are shown in Table 3.

TABLE 3

Relationship between mol fraction of Phase B introduced by iodide substitution, Δ Fog/Dm, and Δ S (Phase A and Phase C: AgBr; Phase B: AgI; molar ratio of Phase A/Phase C = 1/3; crystal habit: cubic)

| Sample No. | Mol Fraction (%) of Ag in Phase B to the Total Ag | Δ Fog/Dm | Δ S |
|---|---|---|---|
| III-1 (Comparative) | 0 | 0.080 | +0.05 |
| III-2 (Invention) | 0.03 | 0.070 | +0.02 |
| III-3 (Invention) | 0.05 | 0.053 | ±0.0 |
| III-4 (Invention) | 0.10 | 0.015 | −0.03 |
| III-5 (Invention) | 0.15 | 0 | −0.08 |

TABLE 3-continued

Relationship between mol fraction of Phase B introduced by iodide substitution, Δ Fog/Dm, and Δ S (Phase A and Phase C: AgBr; Phase B: AgI; molar ratio of Phase A/Phase C = 1/3; crystal habit: cubic)

| Sample No. | Mol Fraction (%) of Ag in Phase B to the Total Ag | Δ Fog/Dm | Δ S |
|---|---|---|---|
| III-6 (Invention) | 0.20 | 0 | −0.10 |

As is clear from Table 3, formation of Phase B in a cubic emulsion also serves to markedly reduce folding fog without causing any serious change in sensitivity.

EXAMPLE 4

Samples IV-1 to IV-3 were prepared in the same manner as in Example 2 except for using an aqueous solution of KBr+KI and simultaneously adding an aqueous solution of $AgNO_3$ in an equivalent amount to the amount of KBr+KI to thereby introduce Phase B (first coating layer) of a 0.2 mol% silver amount. Samples IV-1 to IV-3 were prepared by changing the ratio of KI to KBr as shown in Table 4. The silver halide grains used were 1.4μ monodisperse octahedral grains. These samples were also subjected to the same stress properties test earlier described.

The relationship between iodide mol fraction in Phase B of each sample, ΔFog/Dm, and ΔS are tabulated in Table 4.

TABLE 4

Relationship between AgI mol fraction of Phase B composed of AgBrI, Δ Fog/Dm, and Δ S (Phase A and Phase C: AgBrI (I = 2 mol %); molar ratio of silver in Phase A to that in Phase C = 1/3; Phase B: 0.2 mol % as a silver amount)

| Sample No. | Iodide Mol % in Phase B | Δ Fog/Dm | Δ S |
|---|---|---|---|
| II-1 (Comparative)* | 0 | 0.043 | +0.05 |
| IV-1 (Invention) | 22 | 0.027 | ±0.0 |
| IV-2 (Invention) | 42 | 0.015 | −0.05 |
| IV-3 (Invention) | 100 | 0 | −0.09 |

*Formed per Example 2.

As is clear from Table 4, Samples IV-1 to IV-3 of the present invention in which the AgI content (mol%) of Phase B is different from that of Phase A by 10 mol% or more suffered less change in sensitivity by folding and underwent markedly less change in fog in comparison with Sample II.

EXAMPLE 5

30 g of gelatin, 8 g of potassium bromide, and 80 cc of a 0.1% methanol solution of 3,4-dimethyl-4-thiazoline-2-thione were added to 1 liter of water and, while keeping the reaction vessel temperature at 75° C., 200 ml of an aqueous solution (Solution A) containing 250 g/liter of silver nitrate and 200 ml of an aqueous solution (Solution B) containing 5 g/liter of KI and 206 g/liter of KBr were simultaneously added thereto over 16 minutes according to the double jet-mixing method (Phase A, or core). Then, at 75° C., 100 ml of a KI aqueous solution was added thereto over 10 minutes under stirring to introduce Phase B (first coating layer). Subsequently, 600 ml of Solution A and 600 ml of Solution B were simultaneously added thereto at 75° C. over 45 minutes according to the double jet-mixing method (Phase C, or second coating layer). The thus-obtained silver halide grains were 0.91 μm octahedral silver bromoiodide grains. Samples V-2 to V-5 were obtained by changing the amount of KI used for forming Phase B as 0.1 g, 0.2 g, 0.4 g and 0.8 g per 100 ml aqueous solution. An emulsion not subjected to the introduction of iodide was used for preparing Sample V-1. Chemical ripening and subsequent steps were almost the same as in Example 1, (2), except that, upon chemical ripening, $1.2\times10^{-5}$ mol of chloroauric acid and $2.6\times10^{-5}$ mol of sodium thiosulfate were used per mol of silver. These samples were subjected to the earlier described stress properties test. The relationship between mol fraction of Phase B, ΔFog/Dm, and ΔS are shown in Table 5.

TABLE 5

Relationship between mol fraction of Phase B introduced by substitution with iodide, Δ Fog/Dm, and Δ S (Phase A and Phase C: AgBrI (I = 2 mol %); Phase B: AgI; molar ratio of Phase A/Phase C = 1/3; 0.91 μm size octahedral grains)

| Sample No. | Mol Fraction (%) of Ag in Phase B to the Total Ag | Δ Fog/Dm | Δ S |
|---|---|---|---|
| V-1 (Comparative) | 0 | 0.018 | +0.02 |
| V-2 (Invention) | 0.05 | 0.005 | 0 |
| V-3 (Invention) | 0.10 | 0.005 | 0 |
| V-4 (Invention) | 0.40 | 0.005 | 0 |
| V-5 (Invention) | 1.00 | 0 | −0.04 |

As is clear from Table 5, even comparatively small sized grains in accordance with the present invention provided good results.

EXAMPLE 6

Color light-sensitive material samples comprising a polyethylene terephthalate film support having provided thereon the following two layers were prepared.

First Layer: Red-Sensitive Emulsion Layer

| | |
|---|---|
| Silver bromoiodide emulsion | 2.0 g/m² as coated Ag |
| Sensitizing Dye I | $6\times10^{-5}$ mol per mol of silver |
| Sensitizing Dye II | $1.5\times10^{-5}$ mol per mol of silver |
| Coupler EX-1 | $4.0\times10^{-2}$ mol per mol of silver |
| Coupler EX-2 | $3.0\times10^{-3}$ mol per mol of silver |
| Coupler EX-3 | $6.0\times10^{-4}$ mol per mol of silver |

Second Layer: Protective Layer

A gelatin layer containing trimethyl methacrylate particles (about 1.5μ in diameter) was coated.

In addition to the above-described ingredients, a gelatin hardener, H-1, and a surfactant were added to each layer.

Compounds used for preparing the samples are as follows.

Sensitizing Dye I: Anhydro-5,5'-dichloro-3,3'-di(γ-sulfopropyl)-9-ethylthiacarbocyanine hydroxide pyridinium salt Sensitizing Dye II: Anhydro-9-ethyl-3,3'-di(γ-sulfopropyl)-4,5,4',5'-dibenzothiacarbocyanine hydroxide triethylamine salt

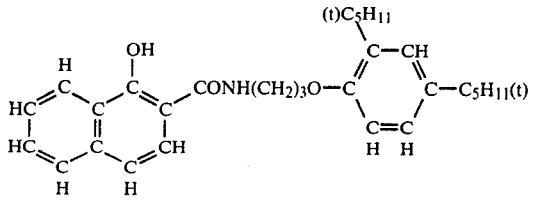

Coupler EX-1

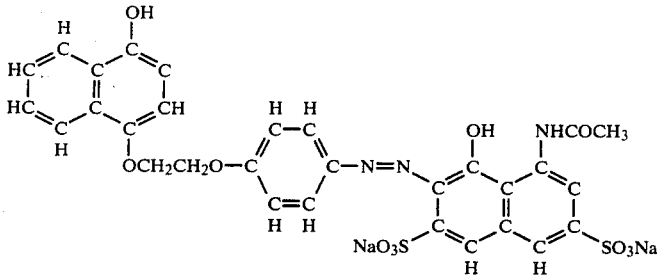

Coupler EX-2

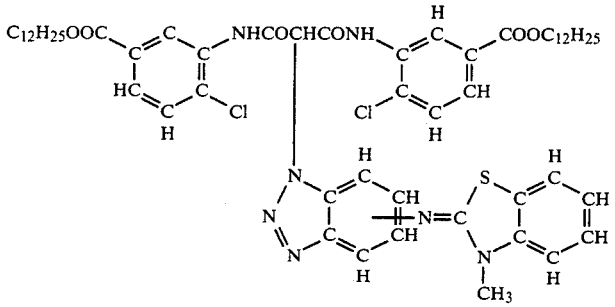

Coupler EX-3

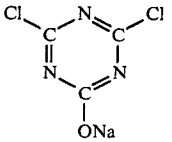

H-1

As the silver bromoiodide emulsion of the first layer, emulsions used for Samples I-1 to I-7 in Example 1 were used to obtain Samples VI-1 to VI-7, respedtively.

The thus-obtained samples were subjected to the stress properties test in the same manner as in Example 1 except for conducting development processing as follows.

| Development Processing Step | Time | Temperature |
|---|---|---|
| 1. Color Development | 3 min 15 sec | 38° C. |
| 2. Bleaching | 6 min 30 sec | " |
| 3. Washing with Water | 3 min 15 sec | " |
| 4. Fixing | 6 min 30 sec | " |
| 5. Washing with Water | 3 min 15 sec | " |
| 6. Stabilizing | 3 min 15 sec | " |

Formulations of the processing solutions used in respective steps are as follows.

| | |
|---|---|
| Color Developer | |
| Sodium Nitrilotriacetate | 1.0 g |
| Sodium Sulfite | 4.0 g |
| Sodium Carbonate | 30.0 g |
| Potassium Bromide | 1.4 g |
| Hydroxylamine Sulfate | 2.4 g |
| 4-(N—Ethyl-N—β hydroxyethylamino)-2-methylaniline Sulfate | 4.5 g |
| Water to make | 1 liter |

-continued

| | |
|---|---|
| Bleaching Solution | |
| Ammonium Bromide | 160.0 g |
| Aqueous Ammonia (28%) | 25.0 cc |
| Sodium Iron Ethylenediaminetetraacetate | 130.0 g |
| Glacial Acetic Acid | 14.0 cc |
| Water to make | 1 liter |
| Fixing Solution | |
| Sodium Tetrapolyphosphate | 2.0 g |
| Sodium Sulfite | 4.0 g |
| Ammonium Thiosulfate (70%) | 175.0 cc |
| Sodium Bisulfite | 4.6 g |
| Water to make | 1 liter |
| Stabilizing Solution | |
| Formalin | 8.0 cc |
| Water to make | 1 liter |

In comparison with Samples VI-1 and VI-7, Samples VI-2 to VI-6 using the emulsions of the present invention underwent less change in sensitivity and less change in fog, thus showing good stress properties.

While the invention has been described in detail and with reference to specific embodiments thereof, it will be apparent to one skilled in the art that various changes and modifications can be made therein without departing from the spirit and scope thereof.

What is claimed is:

1. A silver halide emulsion containing negative working silver halide grains, having surface sensitivity the same as or more than grain internal sensitivity, each comprising a core of silver bromide or silver bromoiodide, a first layer exterior said core composed of silver iodide or silver bromoiodide, and a second layer exterior said first layer composed of silver bromide or silver bromoiodide different from that of the first layer in halide composition, and having a projected area diameter-to-thickness ratio of less than 5, in which:

(1) said first layer contains more iodide than said core by 10 mol% or more; and (2) silver in the first layer accounts for 0.01 to 30 mol% of the total silver in the grain.

2. The silver halide emulsion of claim 1, wherein the content of iodide in said core is 0 to 10 mol%.

3. The silver halide emulsion of claim 1, wherein said core is silver bromide.

4. The silver halide emulsion of claim 1, wherein the silver of said core accounts for 5 mol% or more of that of the total grains.

5. The silver halide emulsion of claim 1, wherein the silver of said first layer accounts for 0.01 to 10 mol% of that of the total grains.

6. The silver halide emulsion of claim 1, wherein the content of iodide in the first layer is 10 to 100 mol%.

7. The silver halide emulsion of claim 1, wherein said first layer is silver iodide.

8. The silver halide emulsion of claim 1, wherein the content of iodide in said second layer is 0 to 10 mol%.

9. The silver halide emulsion of claim 1, wherein said second layer is silver bromide.

10. The silver halide emulsion of claim 1, wherein the silver amount of said second layer is 5 to 90 mol% of that of the total grains.

11. The silver halide emulsion of claim 1, wherein the halide composition of said core or said second layer is homogeneous.

12. The silver halide emulsion of claim 1, wherein the sizes of the grains range from 0.5 to 5.0$\mu$.

13. The silver halide emulsion of claim 1, wherein said silver halide grains account for 40 or more (in terms of the silver amount) of the total silver halide grains in the emulsion.

14. A process for preparing three-layered negative working silver halide grains having surface sensitivity the same as or more than grain internal sensitivity, which comprises forming cores of silver bromide or silver bromoiodide containing 10 mol% or less iodide, forming a first layer of silver bromoiodide or silver iodide on said cores by a halide substitution method or a coating method, and providing a second layer of silver bromoiodide different from that of the first layer in halide composition or silver bromide on said first layer, said first layer containing iodide in an amount greater than that of said cores by at least 10 mol% and the silver amount of said first layer accounting for 0.01 to 30 mol% of that of the total silver halide grains.

15. The process of claim 14, wherein said first layer is silver iodide.

16. The process of claim 14, wherein said first layer is silver bromoiodide containing 20 mol% or more iodide.

17. The process of claim 14, wherein the silver of the first layer accounts for 0.01 to 10 mol% of the silver of the total grains.

18. the process of claim 14, wherein the pAg during formation of the cores is 7.0 to 11.0.

19. The process of claim 14, wherein a silver halide solvent is present upon and/or after formation of the cores.

20. The process of claim 14, wherein the first layer is formed on the cores by a double jet-mixing method or a controlled double jet method.

* * * * *